US006786829B1

(12) United States Patent
Tseng

(10) Patent No.: US 6,786,829 B1
(45) Date of Patent: Sep. 7, 2004

(54) SWING HAVING SEAT UNITS WITH TILTABLE BACKRESTS

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 0 days.

(21) Appl. No.: 10/440,546

(22) Filed: May 16, 2003

(51) Int. Cl.[7] ..... A63G 9/00

(52) U.S. Cl. ..... 472/125; 297/232; 297/368; 297/372

(58) Field of Search ..... 472/118, 125; 297/232, 368, 359, 372

(56) References Cited

U.S. PATENT DOCUMENTS 427,900 A * 5/1890 Pearson ..... 297/90
531,472 A * 12/1894 Shorey ..... 248/163.2
572,271 A * 12/1896 Nelsen ..... 297/271.1
5,306,072 A * 4/1994 Caldwell ..... 297/232
5,957,780 A * 9/1999 Grazioli ..... 472/118
6,348,005 B1 * 2/2002 Tseng ..... 472/118
6,585,319 B2 * 7/2003 Tseng ..... 297/281
6,648,768 B1 * 11/2003 Tseng ..... 472/118

* cited by examiner

*Primary Examiner*—Kien Nguyen
(74) *Attorney, Agent, or Firm*—Ladas & Parry

(57) ABSTRACT

A swing includes two seat units swingably connected to an upright support frame through suspending members. Each seat unit includes a seat frame disposed between inner and outer side frames, and a backrest frame pivoted to the seat frame. Inner and outer engaging plates are fixed respectively to the inner and outer side frames, and are each formed with a plurality of intercommunicated engaging grooves. Inner and outer operating arms are respectively disposed adjacent to the engaging plates. Each of the operating arms has a rear arm section pivoted to the backrest frame and a front arm section formed with an engaging tongue that engages a selected one of the engaging grooves in the respective engaging plate.

2 Claims, 5 Drawing Sheets

SWING HAVING SEAT UNITS WITH TILTABLE BACKRESTS

BACKGROUND OF THE INVENTION

1. Field of the Invention

The present invention relates to a swing, more particularly to a swing having seat units with tiltable backrests.

2. Description of the Related Art

A conventional swing includes a seat unit and an upright support frame unit. The support frame unit has left and right support frames and a transverse rod fixed to top ends of the frames. The seat unit includes left and right side frames swingably connected to the transverse rod through suspending members, such as cords or chains. A seat frame is disposed between the left and right side frames, and is fixed to a backrest frame.

SUMMARY OF THE INVENTION

The object of this invention is to provide a swing having seat units with tiltable backrests.

According to the present invention, a swing includes a pair of seat units and an upright support frame. Each of the seat units includes front and rear connecting rods extending in a longitudinal direction, and spaced apart inverted U-shaped inner and outer side frames that extend in a transverse direction relative to the longitudinal direction and that respectively have inner and outer front legs connected to the front connecting rod, and inner and outer rear legs connected to the rear connecting rod, each of the seat units further including a seat frame disposed between the inner and outer side frames, a first pivot, a backrest frame extending upwardly from and pivoted to the seat frame through the first pivot, and an inclination-adjusting unit including a second pivot that is parallel to and that is disposed at an elevation above the first pivot, opposite inner and outer engaging plates that are fixed respectively to the inner and outer side frames and that extend in the transverse direction, and opposite elongated inner and outer operating arms that extend in the transverse direction and that are disposed respectively adjacent and parallel to the inner and outer engaging plates, each of the inner and outer engaging plates being formed with a plurality of intercommunicated engaging grooves, each of the inner and outer operating arms having a rear arm section that is pivoted to the backrest frame through the second pivot, and a front arm section that is formed with an engaging tongue extending transversely therefrom and engaging a selected one said engaging grooves in a respective one of the engaging plates, thereby positioning the backrest frame at a desired angle relative to the seat frame. The upright support frame has opposite top and bottom ends, and left and right suspending members having upper ends connected swingably to the top end of the support frame, and lower ends connected swingably and respectively to the outer side frames of the seat units.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
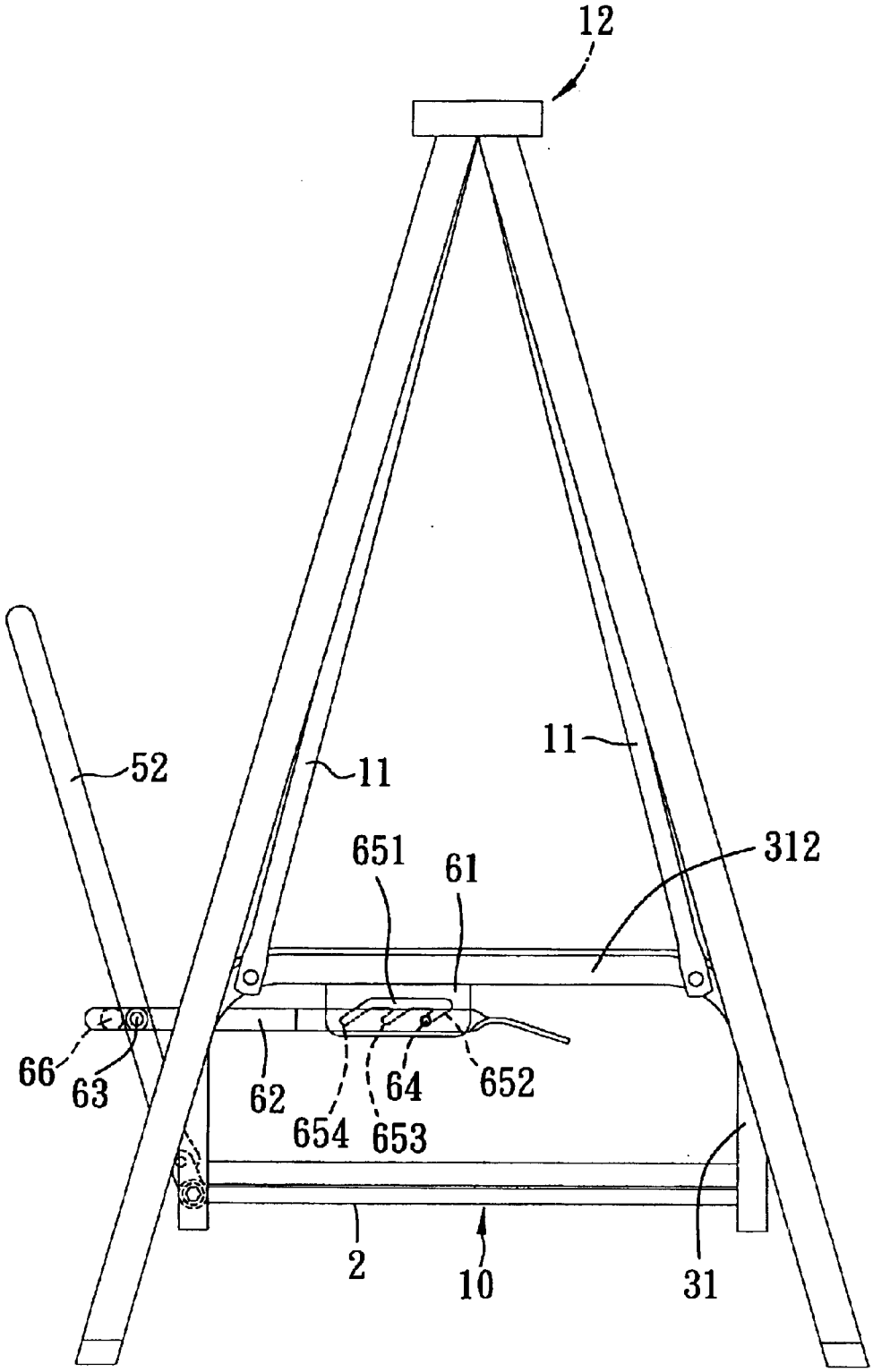
FIG. 1 is a schematic side view of the preferred embodiment of a swing according to the present invention.
Figure 2:
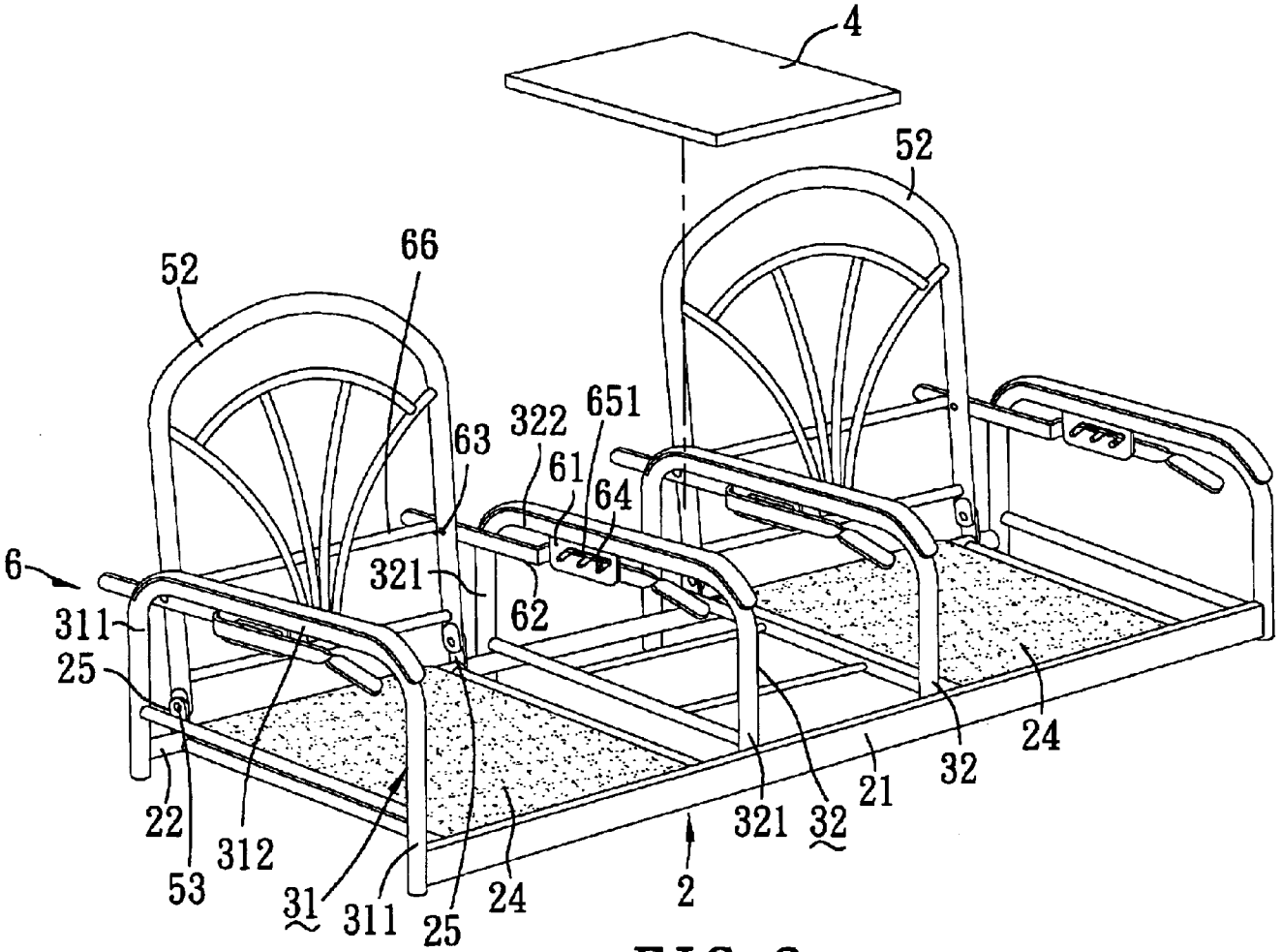
FIG. 2 is a perspective view of two seat units of the preferred embodiment.

Referring to FIGS. 1 and 2, the preferred embodiment of a swing 10 according to the present invention is shown to include a pair of seat units 2 and an upright support frame 12.

As illustrated, each of the seat units 2 includes front and rear connecting rods 21,22 extending in a longitudinal direction, spaced apart inverted U-shaped inner and outer side frames 32,31, a seat frame 24, a backrest frame 52, two first pivots 53, a pair of brackets 25, and an inclination-adjusting unit 6.

The inner and outer side frames 32,31 extend in a transverse direction relative to the longitudinal direction, and respectively have inner and outer front legs 321,311 connected to the front connecting rod 21, and inner and outer rear legs 321,311 connected to the rear connecting rod 22.

The seat frame 24 is disposed between the inner and outer side frames 32,31, and is connected to the front and rear connecting rods 21,22.

The brackets 25 are fixed to the rear connecting rod 22. The backrest frame 52 extends upwardly from and is pivoted to the brackets 25 of the seat frame 24 through the first pivots 53.

Figure 3:
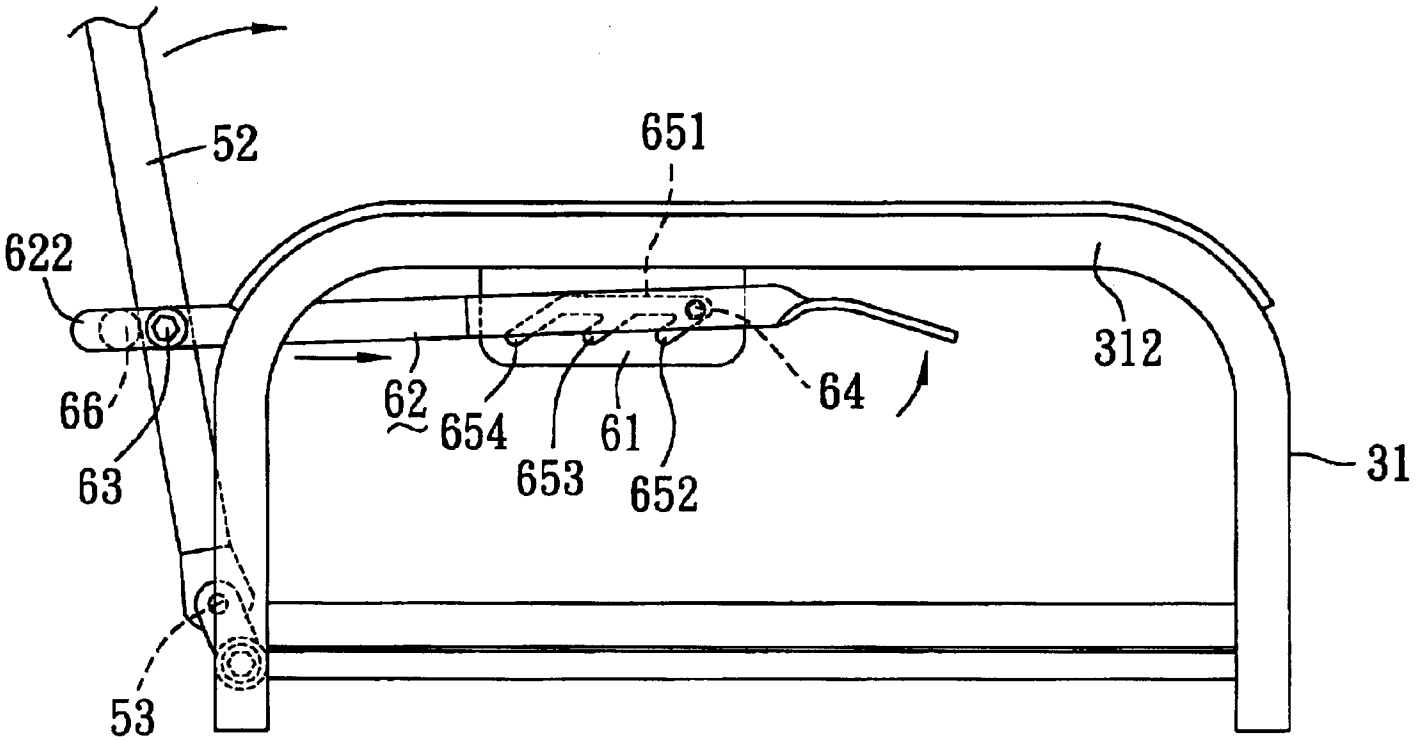
FIG. 3 is a fragmentary side view of the preferred embodiment, illustrating how a backrest frame is tilted forward in order to adjust position of the same relative to a seat frame.

The inclination-adjusting unit 6 includes two second pivots 63, opposite inner and outer engaging plates 61, and opposite elongated inner and outer operating arms 62. The second pivots 63 are parallel to and are disposed at an elevation above the first pivots 53, respectively. The inner and outer engaging plates 61 extend in the transverse direction and are fixed respectively to armrest portions 322,312 of the inner and outer side frames 32,31. The elongated inner and outer operating arms 62 extend in the, transverse direction, and are disposed respectively adjacent to the inner and outer engaging plates 61. Each of the inner and outer engaging plates 61 is formed with a plurality of intercommunicated engaging grooves 652,653, 654. Each of the inner and outer operating arms 62 has a rear arm section 622 pivoted to the backrest frame 52 through a respective one of the second pivots 63, and a front arm section 621 formed with an engaging tongue 64 that extends transversely therefrom and that engages a selected one of the engaging grooves 652 in a respective one of the engaging plates 61, thereby positioning the backrest frame 52 at a desired angle relative to the seat frame 24, as best shown in FIG. 3.

The upright support frame 12 has opposite top and bottom ends, and left and right suspending members 11 that have upper ends connected swingably to the top end of the support frame 12, and lower ends connected swingably and respectively to the armrest portions 312,322 of the outer side frames 31 of the seat units 2.

Preferably, a horizontal support plate 4 is disposed on and cooperates with the inner side frames 32 to serve as a tea table.

In this preferred embodiment, each of the inner and outer engaging plates 61 is formed with a straight elongated slot 651 that extends in the transverse direction and that is spatially communicated with the engaging grooves 652,653, 654. In addition, a reinforcing rod 66 extends between and interconnects the inner and outer operating arms 62, and is disposed rearwardly of the backrest arm 52 so as to facilitate operation of the inner and outer operating arms 62.

Figure 4:
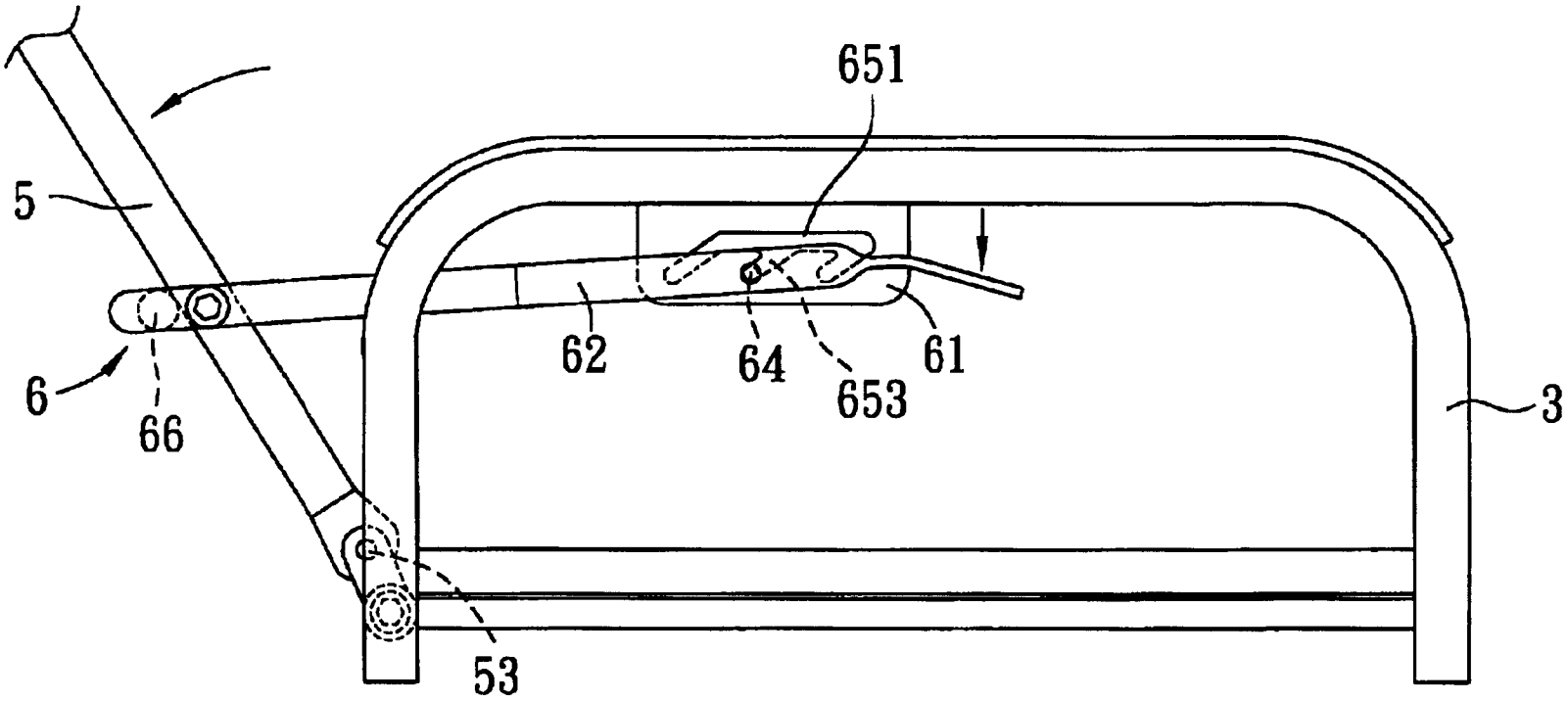
FIG. 4 is a fragmentary side view of the preferred embodiment, illustrating how the backrest frame is tilted rearward in order to adjust an inclination of the same relative to the seat frame.
Figure 5:
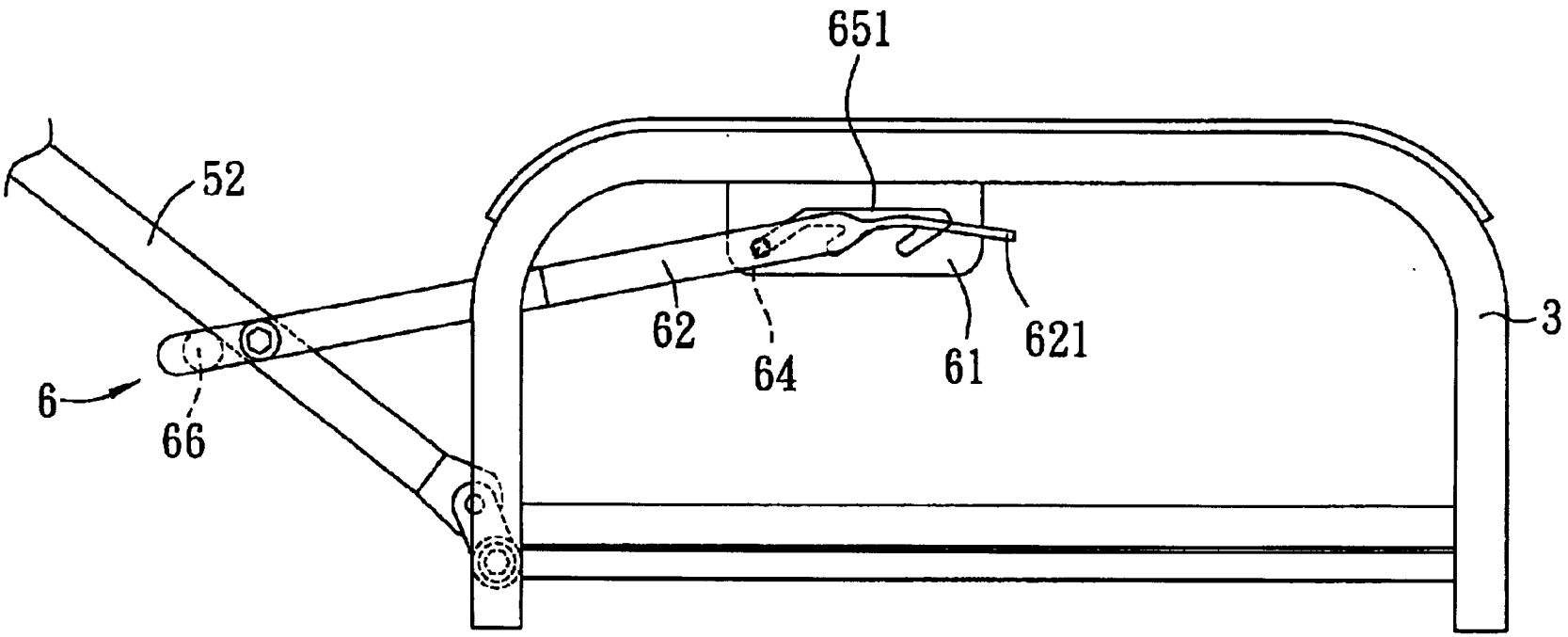
FIG. 5 is a fragmentary side view of the preferred embodiment, illustrating how two elongated operating arms are moved relative to side frames in order to adjust the inclination of the backrest frame relative to the seat frame.

Referring to FIG. 3, when it is desired to adjust the position of the backrest frame 52 relative to the seat frame 24 of one of the seat units 2, the backrest frame 52 is moved forward to result in disengagement of each of the engaging tongues 64 of the inner and outer operating arms 62 from a selected one of the engaging grooves 652, 653,654 in a respective one of the inner and outer engaging plates 61 and subsequent movement of the same into the elongated slot 651 in the respective one of the engaging plates 61. Under this condition, the backrest frame 52 can be pushed rearward by body weight of the seated person, and the inner and outer operating arms 62 can be pressed downward so as to permit the engaging tongue 64 of each of the inner and outer operating arms 62 to engage another selected one of the engaging grooves 652, 653, 654, thereby positioning the backrest frame 52 at a different inclination with respect to the seat frame 24, as shown in FIGS. 4 and 5.

With this invention thus explained, it is apparent that numerous modifications and variations can be made without departing from the scope and spirit of this invention. It is therefore intended that the invention be limited only as indicated in the appended claims.

I claim:

1. A swing comprising:

a pair of seat units, each of said seat units including front and rear connecting rods extending in a longitudinal direction, spaced apart inverted U-shaped inner and outer side frames extending in a transverse direction relative to said longitudinal direction and respectively having inner and outer front legs connected to said front connecting rod, and inner and outer rear legs connected to said rear connecting rod, a seat frame disposed between said inner and outer side frames, a first pivot, a backrest frame extending upwardly from and pivoted to said seat frame through said first pivot, and an inclination-adjusting unit including a second pivot that is parallel to and that is disposed at an elevation above said first pivot, opposite inner and outer engaging plates that are fixed respectively to said inner and outer side frames and that extend in said transverse direction, and opposite elongated inner and outer operating arms extending in said transverse direction and disposed respectively adjacent to said inner and outer engaging plates, each of said inner and outer engaging plates being formed with a plurality of intercommunicated engaging grooves, each of said inner and outer operating arms having a rear arm section pivoted to said backrest frame through the second pivot, and a front arm section formed with an engaging tongue that extends transversely therefrom and that engages a selected one said engaging grooves in a respective one of said engaging plates, thereby positioning said backrest frame at a desired angle relative to said seat frame; and an upright support frame having opposite top and bottom ends, and left and right suspending members having upper ends connected swingably to said top end of said support frame, and lower ends connected swingably and respectively to said outer side frames of said seat units.

2. The swing as defined in claim 1, further comprising a horizontal support plate that is disposed on and that cooperates with said inner side frames of said seat units to serve as a tea table.

* * * * *